United States Patent [19]

Montgomery

[11] Patent Number: 4,544,420

[45] Date of Patent: Oct. 1, 1985

[54] WROUGHT ALLOY BODY AND METHOD

[75] Inventor: Dale Montgomery, Drumore, Pa.

[73] Assignee: Electralloy Corporation, New York, N.Y.

[21] Appl. No.: 471,024

[22] Filed: Mar. 1, 1983

[51] Int. Cl.[4] ..... C22C 38/44

[52] U.S. Cl. ..... 148/37; 148/12 E; 75/128 W; 75/128 N

[58] Field of Search ..... 75/128 W, 128 N; 148/31, 37, 38, 12 E, 12 EA

[56] References Cited

U.S. PATENT DOCUMENTS 3,650,709 3/1972 Morsing ..... 75/128 W
4,058,417 11/1977 Bicicchi et al. ..... 148/12 EA

FOREIGN PATENT DOCUMENTS 0059896 9/1982 European Pat. Off. ..... 75/128 W

OTHER PUBLICATIONS

Nachschlagwerk Stahlschlüssel, 10, Edition 1974.
ASTM specification A-743-83, (1983), pp. 4-7.
Fischer and Larson, CA6NM to Rc 22 Max, undated.
ASTM specification A370-77, (1977), pp. 293, 319-323.
J. D. Crawford and K. Rohrig, "A Foundry Success Story . . . CA-6NM".
James D. Crawford, "CA-6NM—an Update".
"CA-6NM: A Stainless Steel Casting Alloy".
Allegheny Ludlum "Stainless Steel": Allegheny Ludlum's types 414 and 431.
Leroy Finch, "CA-6NM, (Esco 33 G): A Casting Blade with Good Finishing Quality", Feb. 1972.
Alloy Casting Institute Data Sheet, Aug. 1973.
ASTM specifications A-743 and A-744, 1979.

*Primary Examiner*—L. Dewayne Rutledge
*Assistant Examiner*—Debbie Yee
*Attorney, Agent, or Firm*—Curtis, Morris & Safford

[57] ABSTRACT

A wrought alloy body is formed of a CA-6NM type alloy comprising by weight from about 11.5% to about 14.0% chromium, about 4.2% to about 5.5% nickel, about 0.010% to about 0.040% carbon, about 0.75% to about 0.92% manganese, about 0.28% to about 0.62% silicon, about 0.65% to about 0.83% molybdenum; not more than about 0.035% phosphorus, 0.015% sulphur and 0.025% nitrogen; and the remainder iron and incidental residuals. The alloy exhibits yield strength above about 100,000 psi, tensile strength above about 120,000 psi at room temperature and impact strength above about 90 ft. lbs. at 0° C. A method is provided for producing said wrought body by hot working.

9 Claims, No Drawings

WROUGHT ALLOY BODY AND METHOD

BACKGROUND OF THE INVENTION

This invention relates to a corrosion resistant iron-chromium-nickel-molybdenum alloy suitable for use in its wrought form, and to a method of producing a wrought alloy body from said alloy.

More specifically, this invention relates to a wrought analog of a type CA-6NM alloy casting (ASTM specification A-743 and A744) and a method for producing a wrought body by rolling at elevated temperature.

Type CA-6NM cast stainless steel has a nominal composition by weight of 12% chromium, 4% nickel and 0.4 to 1.0% molybdenum, a maximum carbon content of 0.06%, and the remainder substantially iron. ASTM specifications recite the following chemistry for CA-6NM:

| ELEMENT | WEIGHT % |
|---|---|
| Cr | 11.5–14.0 |
| Ni | 3.5–4.5 |
| C | 0.06 max |
| Mn | 1.00 max |
| Si | 1.00 max |
| Mo | 0.40–1.00 |
| P | 0.04 max |
| S | 0.04 max |
| Fe + residuals | remainder |

Type CA-6NM alloy is hardenable by heat treatment, exhibits good corrosion and cavitation resistance properties and is used in many applications including castings for the hydroelectric industry, pump castings, valve bodies, compressor impellers, diffuser impellers, turbine blades, steam and gas turbine casings and ship propellers.

Type CA-6NM alloy was developed primarily in response to the low impact strength of CA-15 (ASTM specification A-351). For example, the Charpy V-notch impact strength of the CA-15 alloy is about 15 ft. lbs. at 32° F. whereas the minimum impact strength of the CA-6NM alloy is about 30 ft. lbs. with actual values of about 65 ft. lbs. at 32° F.

CA-6NM also shows improved casting behavior over the CA-15 alloy with a lower tendency toward cracking during and after solidification of heavy sections, and therefore requires less need for repair welding.

Historically, standard CA-6NM chemistries have been somewhat unsuitable for hot working due to the relatively low elongations and reduction of area percentages. Heretofore, CA-6NM type alloy bodies have been used only in their cast and heat treated states. Consequently, none of the advantages imparted by hot working an alloy body to form a wrought product are present in commercially available CA-6NM alloy bodies.

As is known generally, hot working imparts to an alloy body beneficial properties which cannot be obtained satisfactorily by other techniques. For example, hot working provides controlled directional physical properties to the alloy body, resulting in significant advantages in engineering designs that account for differences in transverse and longitudinal properties. Previously, castings had to be reinforced in areas of greater stress in order to obtain greater strength and resistance to cracking to compensate for homogeneity in physical properties. A body formed from the wrought alloy of the present invention inherently is stronger in the direction of the major hot working thereby simplifying certain design considerations. Furthermore, the yield, tensile and impact strength of the alloy body are increased by hot working.

OBJECTS OF THE INVENTION

It is therefore an object of this invention to produce a wrought CA-6NM type alloy body.

Another object of this invention is to produce a CA-6NM alloy body which exhibits controlled directionality in its properties.

A further object of this invention is to produce a wrought CA-6NM type alloy body which exhibits greater yield and tensile strength than its cast analog.

Yet another object of this invention is to produce a wrought CA-6NM type alloy body which exhibits greater impact strength than its cast analog.

Still another object of this invention is to provide a CA-6NM type alloy which exhibits sufficient ductility at conventional hot working temperatures to permit formation of a wrought body with yield strength above about 100,000 psi and tensile strength above about 120,000 psi at room temperature and impact strength above about 90 ft. lbs. at 0° C.

SUMMARY OF THE INVENTION

The foregoing and other objects are attained in accordance with the present invention.

In one embodiment a wrought alloy body is formed of a CA-6NM type alloy composition comprising by weight from about 11.5% to 14.0% chromium, about 4.0% to about 5.5% nickel, about 0.010% to about 0.040% carbon, about 0.6% to 1.0% manganese, about 0.2% to 0.8% silicon, about 0.5% to 0.9% molybdenum; not more than about 0.04% phosphorus, 0.02% sulphur and 0.03% nitrogen; and the remainder iron and incidental residuals.

In another of its aspects, the invention is in a method for producing a wrought alloy body which comprises heating a cast material having a composition comprising by weight from about 11.5% to about 14.0% chromium, about 4.2% to about 4.5% nickel, about 0.010% to about 0.040% carbon, about 0.75% to about 0.92% manganese, about 0.28% to about 0.62% silicon, about 0.65% to about 0.83% molybdenum, not more than about 0.035% phosphorus, 0.015% sulphur and 0.025% nitrogen, and the remainder iron and incidental residuals, to a temperature of from about 2000° F. to about 2500° F., hot working said heated material to from about 1650° F. to about 1880° F., and heat treating said hot worked material.

DESCRIPTION OF PREFERRED EMBODIMENTS

Preferably, said alloy composition comprises by weight from about 11.5% to about 14.0% chromium, about 4.2% to about 5.5% nickel, about 0.010% to about 0.030% carbon, about 0.75% to about 0.92% manganese, about 0.28% to about 0.62% silicon, about 0.65% to about 0.83% molybdenum; not more than about 0.035% phosphorus, 0.015% sulphur and 0.025% nitrogen; and the remainder iron and incidental residuals.

It is especially preferred that said wrought alloy body be formed of a CA-6NM type alloy composition comprising by weight from about 11.5% to 12.5% chromium, about 4.2% to about 4.5% nickel, about 0.010% to about 0.020% carbon, about 0.75% to 0.85% manganese, about 0.35% to 0.45% silicon, about 0.65% to 0.75% molybdenum; not more than about 0.030% phosphorus, 0.010% sulphur and 0.015% nitrogen; and the remainder iron and incidental residuals.

The composition of the alloy is especially characterized by the combination of a lower carbon content, higher nickel content and lower sulfur content as compared to conventionally produced type CA-6NM cast stainless steel. With A O D refining, the ability to provide extremely low hydrogen, nitrogen and sulphur is greatly enhanced, thereby minimizing the detrimental effects of hydrogen embrittlement and sulfide stress corrosion. The changes made expand the single phase austenite region and as such, there exists less restrictions on the hot working range. As is common knowledge, hot working in a single phase region is very desirable in contrast to a dual phase region.

The simultaneous lowering of the carbon to a value of approximately 0.010% by weight and elevating of the nickel to a value of approximately 5.5% by weight would enhance the toughness properties as would be reflected in elevated impact values. In addition, at 0.010% by weight carbon and 5.5% by weight nickel the finished product would remain 100% martensitic.

In the present invention, the carbon level is reduced to from about 0.010% to about 0.040% by weight, and preferably 0.010% to 0.030% by weight, and especially 0.010% to 0.020% by weight; whereas the conventional type CA-6NM casting specifications allow a maximum carbon content of 0.06% by weight, and standard commercial products exhibit a carbon content of about 0.04% by weight.

In the present invention, the nickel content is increased to from about 4.0% to about 5.5% by weight, with a preferred range of 4.2% to 5.5%, for example about 4.3% weight; whereas the conventional type CA-6NM castings nominally contain 4% by weight of nickel, with 3.7% to 3.9% being typical.

In the present invention, the sulfur content is reduced to about 0.020% by weight, preferably 0.010% by weight, and especially 0.004% by weight; whereas the conventional type CA-6NM casting specifications allow a maximum sulfur level of 0.04% by weight.

The combination of lower carbon, higher nickel and lower sulfur content imparts sufficient ductility at elevated temperature to an alloy body having the composition of the present invention to enable one skilled in the art to hot work the alloy body without detrimental effects, such as cracking. Moreover, the wrought product possesses sufficient strength and hardness for commercial application in the harsh environments for which the type CA-6NM alloy was developed. At room temperature 0.2% offset yield strength of up to 136,000 psi, tensile strength of up to 145,000 psi, elongation of up to 20% and reduction of area of up to 62% and, at 0° C., Charpy V-notch impact strength of up to 116 ft. lbs. are attainable in the heat treated wrought product. In addition, the wrought product advantageously retains comparable corrosion and cavitation resistance properties as found in type CA-6NM castings.

An alloy body in accordance with the present invention is suitably heated and hot worked by conventional techniques. Preferably, the body is heated to a temperature of from about 2000° F. to about 2500° F. and hot worked by rolling until the temperature decreases to from about 1650° F. to about 1880° F. In an especially preferred embodiment, the body is rolled at a rate of from about 1 inch to 1/1000 inch reduction in thickness per pass until the dimension of the body is reduced from about 60% to about 90L % by the hot working. A total reduction of around 75% is particularly preferred. The final thickness of the plate may range from 3/16 inch to $8\frac{1}{2}$ inches.

Alternatively, the hot working may be carried out by other conventional techniques, including forging and extrustion, with modifications, if necessary, to adapt the particular hot working method to the teachings of the invention.

Further objects of this invention, together with additional features contributing thereto and advantages accruing therefrom, will be apparent from the following examples of the invention.

EXAMPLE 1

A melt with the following chemistry was prepared:

| ELEMENT | WEIGHT % |
|---|---|
| Cr | 12.03 |
| Ni | 4.30 |
| C | 0.026 |
| Mn | 0.84 |
| Si | 0.42 |
| Mo | 0.70 |
| P | 0.024 |
| S | 0.008 |
| N | 0.015 |
| Fe + residuals | remainder |

The alloy was poured as a 48 in. wide by 17 in. thick by 81 in. long ingot weighing approximately 15,500 lbs. The cooled ingot was ground to remove surface defects (optional depending on the condition of the casting). It then was heated and soaked for one hour at 1200° F. to ensure that the temperature is equalized throughout the ingot. The temperature of the ingot was then raised at a rate of 125° F. per hour until it reached 2000° F. This temperature was equalized throughout the body, preferably by soaking the ingot at this temperature, and then the temperature was raised at a rate of 125° F. per hour to a final temperature of 2250° F. Preferably, the final temperature also is equalized, as by soaking the ingot thereat.

Starting at this final temperature of 2250° F., the ingot was rolled to 1.77 in. plate gauge by 30 to 40 reductions. For each pass of the rolling mechanism, the thickness of the ingot was reduced by about $\frac{1}{2}$ in. at the beginning of the rolling step and by the same or smaller amounts as the surface area of the ingot increased and the temperature of the ingot decreased. The thickness of the ingot was reduced from 17 in. to 1.77 in., which amounts to about a 88% reduction. The finish temperature of the ingot upon completion of the rolling was approximately 1675° F. to 1880° F.

The material was hardened by heat treating at 1925° F. and air cooled followed by a temper of 1100° F. and air cooled once again.

Test bars taken from a subsurface position to measure the physical properties of the wrought alloy body in accordance with ASTM standards exhibited properties at room temperature as follows:

TABLE I

| PROPERTY | VALUE |
|---|---|
| Yield strength, 0.2% offset | 124,600 psi |
| Tensile strength | 132,200 psi |
| Elongation, in 2 inches | 18% |

TABLE I-continued

| PROPERTY | VALUE |
|---|---|
| Reduction of area | 62% |
| Brinell hardness | 255 |
| Charpy V-notch impact strength (0° C.) | 109.9 ft. lbs. |

The following physical properties were measured citing the influence of elevated temperature on short time tensile properties:

TABLE II

| TEMPERATURE | TENSILE STRENGTH (psi) | 0.2% OFFSET YIELD STRENGTH (psi) | ELONGATION IN 2 IN. (%) | REDUCTION OF AREA (%) |
|---|---|---|---|---|
| 900° F. | 92,184 | 80,561 | 21 | 72.9 |
| 1000° F. | 78,557 | 68,937 | 28 | 81.3 |
| 1100° F. | 61,723 | 54,509 | 35 | 87.5 |
| 1150° F. | 51,919 | 42,424 | 36 | 90.1 |
| 1200° F. | 41,683 | 32,264 | 61 | 90.5 |

At elevated temperatures, the low yield and tensile strength and high elongation and reduction of area values indicate that the alloy can be hot worked with relative ease.

For comparison, conventonal cast CA-6NM body having the following chemical analysis was tested:

| ELEMENT | WEIGHT % |
|---|---|
| Cr | 12.89 |
| Ni | 3.79 |
| C | 0.043 |
| Mn | 0.73 |
| Si | 0.59 |
| Mo | 0.46 |
| P | 0.027 |
| S | 0.015 |
| N | not tested |
| Fe + residuals | remainder |

Test bars from the cast structure yielded the following measured values at room temperature:

TABLE III

| PROPERTY | VALUE |
|---|---|
| Yield strength, 0.2% offset | 105,700 psi |
| Tensile strength | 123,500 psi |
| Elongation, in 2 inches | 22% |
| Reduction of area | 57% |
| Charpy V-notch impact strength (0° C.) | 55.7 ft. lbs. |

From a comparison of Tables I and III, it is seen that the wrought body of the present invention exhibits greater yield, tensile and impact strength than conventional cast material.

EXAMPLE 2

A melt with the following chemistry was prepared:

| ELEMENT | WEIGHT % |
|---|---|
| Cr | 11.99 |
| Ni | 4.34 |
| C | 0.012 |
| Mn | 0.84 |
| Si | 0.54 |
| Mo | 0.70 |
| P | 0.022 |
| S | 0.006 |
| N | 0.012 |

-continued

| ELEMENT | WEIGHT % |
|---|---|
| Fe + residuals | remainder |

The alloy was poured as a 52 in. wide by 22 in. thick by 92 in. long ingot weighing approximately 25,200 pounds. The same steps were performed as in Example 1 to heat the ingot to a final temperature of 2250° F. The ingot then was rolled to 3 in. plate gauge by 30 to 40 reductions of a reduction in thickness not greater than ½ in. for each pass of the rolling mechanism. The thickness of the ingot was reduced from 22 in. to 3 in., which amounts to about a 86% reduction. The finish temperature of the ingot upon completion of the rolling was approximately 1675° F. to 1880° F.

The wrought body then was treated as set forth in Example 1.

Test bars taken from a subsurface position of the wrought alloy body had the following measured values at room temperature:

TABLE IV

| PROPERTY | VALUE |
|---|---|
| Yield strength, 0.2% offset | 121,400 psi |
| Tensile strength | 138,800 psi |
| Elongation, in 2 inches | 20% |
| Reduction of area | 62% |
| Brinell hardness | 255 |
| Charpy V-notch impact strength (0° C.) | 92.2 ft. lbs. |

EXAMPLE 3

A melt with the following chemistry was prepared:

| ELEMENT | WEIGHT % |
|---|---|
| Cr | 12.12 |
| Ni | 4.30 |
| C | 0.017 |
| Mn | 0.79 |
| Si | 0.39 |
| Mo | 0.72 |
| P | 0.023 |
| S | 0.015 |
| N | 0.010 |
| Fe + residuals | remainder |

The alloy was poured as a 15,500 pound ingot, heated, rolled and heat treated, all as in Example 1.

The following physical properties at room temperature was obtained:

TABLE V

| PROPERTY | VALUE |
|---|---|
| Yield strength, 0.2% offset | 118,300 psi |
| Tensile strength | 123,500 psi |
| Elongation, in 2 inches | 19% |
| Reduction of area | 59% |
| Brinell hardness | 253 |

TABLE V-continued

| PROPERTY | VALUE |
|---|---|
| Charpy V-notch impact strength (0° C.) | 93.7 ft. lbs. |

EXAMPLE 4

A melt with the following chemistry was prepared:

| ELEMENT | WEIGHT % |
|---|---|
| Cr | 12.12 |
| Ni | 4.44 |
| C | 0.027 |
| Mn | 0.90 |
| Si | 0.31 |
| Mo | 0.81 |
| P | 0.027 |
| S | 0.010 |
| N | 0.008 |
| Fe + residuals | remainder |

The alloy was poured as a 15,500 pound ingot, heated, rolled and heat treated, all as in Example 1.

The following physical properties at room temperature were obtained:

TABLE VI

| PROPERTY | VALUE |
|---|---|
| Yield strength, 0.2% offset | 125,400 psi |
| Tensile strength | 138,800 psi |
| Elongation, in 2 inches | 18% |
| Reduction of area | 59% |
| Brinell hardness | 265 |
| Charpy V-notch impact strength (0° C.) | 90.7 ft. lbs. |

EXAMPLE 5

A melt with the following chemistry was prepared:

| ELEMENT | WEIGHT % |
|---|---|
| Cr | 11.93 |
| Ni | 4.39 |
| C | 0.033 |
| Mn | 0.78 |
| Si | 0.41 |
| Mo | 0.67 |
| P | 0.024 |
| S | 0.004 |
| N | 0.025 |
| Fe + residuals | remainder |

The alloy was poured as a 15,500 pound ingot as in Example 1, heated as in Example 1, rolled to 2.5 in. plate gauge which amounts to about an 85% reduction and heat treated as in Example 1.

The following physical properties were obtained at room temperature:

TABLE VII

| PROPERTY | VALUE |
|---|---|
| Yield strength, 0.2% offset | 133,800 psi |
| Tensile strength | 142,900 psi |
| Elongation, in 2 inches | 16% |
| Reduction of area | 57% |
| Brinell hardness | 270 |
| Charpy V-notch impact strength (0° C.) | 81.1 ft. lbs. |

EXAMPLE 6

A melt with the following chemistry was prepared:

| ELEMENT | WEIGHT % |
|---|---|
| Cr | 11.83 |
| Ni | 4.25 |
| C | 0.029 |
| Mn | 0.84 |
| Si | 0.60 |
| Mo | 0.68 |
| P | 0.022 |
| S | 0.010 |
| N | 0.010 |
| Fe + residuals | remainder |

The alloy was poured as a 25,200 pound ingot, heated, rolled and heat treated, all as in Example 2.

The following physical properties of the wrought alloy body were measured at room temperature:

TABLE VIII

| PROPERTY | VALUE |
|---|---|
| Yield strength, 0.2% offset | 123,000 psi |
| Tensile strength | 134,500 psi |
| Elongation, in 2 inches | 19% |
| Reduction of area | 58% |
| Brinell hardness | 276 |
| Charpy V-notch impact strength (0° C.) | 116.5 ft. lbs. |

While the invention has been described with reference to specific examples, it will be understood by those skilled in the art that a range of chemistries may be employed and equivalents may be substituted for elements thereof without departing from the scope of the invention. In addition, many modifications may be made to adapt a particular hot working method to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

I claim:

1. A wrought alloy body having yield strength above about 100,000 psi and tensile strength above about 120,000 psi at room temperature and impact strength above about 90 ft. lbs. at 0° C. and consisting essentially of by weight from about 11.5% to about 14.0% chromium, about 4.0% to about 5.5% nickel, about 0.010% to about 0.030% carbon, about 0.6% to about 1.0% manganese, about 0.2% to about 0.8% silicon, about 0.5% to about 0.9% molybdenum; not more than about 0.04% phosphorous, 0.02% sulphur and 0.03% nitrogen; and the remainder iron and incidental residuals, said alloy body having a fully martensitic structure.

2. A wrought alloy body having yield strength above about 100,000 psi and tensile strength above about 120,000 psi at room temperature and impact strength above about 90 ft. lbs. at 0° C. and consisting essentially of by weight from about 11.5% to about 14.0% chromium, about 4.2% to about 5.5% nickel, about 0.010% to about 0.030% carbon, about 0.75% to about 0.92% manganese, about 0.28% to about 0.62% silicon, about 0.65% to about 0.83% molybdenum; not more than about 0.035% phosphorous, 0.015% sulphur and 0.025% nitrogen; and the remainder iron and incidental residuals, said alloy body having a fully martensitic structure.

3. A wrought alloy body having yield strength above about 100,000 psi and tensile strength above about 120,000 psi at room temperature and impact strength above about 90 ft. lbs. at 0° C. and consisting essentially by weight from about 11.5% to 12.5% chromium, about 4.2% to about 4.5% nickel, about 0.010% to about 0.020% carbon, about 0.75% to about 0.85% manganese, about 0.35% to about 0.45% silicon, about 0.65% to about 0.75% molybdenum; not more than about 0.030% phosphorus, 0.010% sulphur and 0.015% nitrogen; and the remainder iron and incidental residuals, said alloy body having a fully martensitic structure.

4. An alloy body having yield strength above about 100,000 psi and tensile strength above about 120,000 psi at room temperature and impact strength above about 90 ft. lbs. at 0° C. and formed by hot working a cast body having a composition consisting essentially of by weight from about 11.5% to about 14.0% chromium, about 4.2% to about 5.5% nickel, about 0.010% to about 0.030% carbon, about 0.75% to about 0.92% manganese, about 0.28% to about 0.62% silicon, about 0.65% to about 0.83% molybdenum; not more than about 0.035% phosphorus, 0.015% sulphur and 0.025% nitrogen; and the remainder iron and incidental residuals, said alloy body having a fully martensitic structure.

5. A method for producing a wrought alloy body having yield strength above about 100,000 psi and tensile strength above about 120,000 psi at room temperature and impact strength above about 90 ft. lbs. at 0° C. and having a fully martensitic structure, which comprises heating a cast material having a composition consisting essentially of by weight from about 11.5% to about 14.0% chromium, about 4.2% to about 5.5% nickel, about 0.010% to about 0.030% carbon, about 0.75% to about 0.92% manganese, about 0.28% to about 0.62% silicon, about 0.65% to about 0.83% molybdenum, not more than about 0.035% phosphorus, 0.015% sulphur and 0.025% nitrogen, and the remainder iron and incidental residuals, to a temperature of from about 2000° F. to about 2500° F. to form a heated material, hot working said heated material until it cools to from about 1650° F. to about 1880° F. to form a hot worked material, and heat treating said hot worked material.

6. A method as defined in claim 5, wherein the body is hot worked by rolling at a rate of not more than 1 inch reduction in thickness per pass.

7. A method as defined in claim 5, wherein the initial dimension of the body is reduced to a value in the range from about 60% to about 90% of the initial dimension by the hot working.

8. A method as defined in claim 5, wherein said range is from about 75% to about 90%.

9. A method as defined in claim 6, wherein the body is rolled to reduce the thickness thereof by ½ inch initially, with progressively decreasing thickness reductions in subsequent passes.

* * * * *